US005502534A

United States Patent [19]

Lynch et al.

[11] Patent Number: 5,502,534

[45] Date of Patent: Mar. 26, 1996

[54] AUTOMATED PHOTO DEVELOPING MACHINE

[75] Inventors: Marine D. Lynch, Beaverton; James W. Bernklau, Tigard; Corey L. Davis, Beaverton; Raymond J. Easton, Portland; Robert E. Lach; Richard D. Paulson, both of Beaverton, all of Oreg.

[73] Assignee: Wing-Lynch, Inc., Beaverton, Oreg.

[21] Appl. No.: 307,268

[22] Filed: Sep. 16, 1994

[51] Int. Cl.[6] ..... G03D 3/02

[52] U.S. Cl. ..... 354/323; 354/330; 354/325

[58] Field of Search ..... 354/323, 324, 354/325, 328–332; 134/122 P, 64 P, 64 R

[56] References Cited

U.S. PATENT DOCUMENTS

| | | | |
|---|---|---|---|
| Re. 34,188 | 3/1993 | Kuzyk et al. | 354/324 X |
| 3,383,922 | 5/1968 | Seamans, Jr. | 73/419 |
| 3,727,535 | 4/1973 | Streeter | 354/325 |
| 3,744,316 | 7/1973 | Kuzyk | 73/701 |
| 3,780,263 | 12/1973 | Kuzyk | 219/501 |
| 3,792,487 | 2/1974 | Peres | 354/323 X |
| 3,938,171 | 2/1976 | Masygan | 354/324 X |
| 4,074,298 | 2/1978 | Cartwright | 354/331 X |
| 4,211,481 | 7/1980 | Bernhardt | 354/331 X |
| 4,248,530 | 2/1981 | Bockemühl-Simon et al. | 355/74 |
| 4,410,034 | 10/1983 | Bernhardt et al. | 165/805 |
| 4,448,365 | 5/1984 | Petsching et al. | 242/602.3 |
| 4,461,555 | 7/1984 | Kuzyk et al. | 354/323 X |
| 4,473,283 | 9/1984 | Bernhardt et al. | 354/323 |
| 4,586,805 | 5/1986 | Bockemühl-Simon et al. | 354/323 |
| 4,690,546 | 9/1987 | Kuzyk et al. | 355/69 |
| 4,708,451 | 11/1987 | Wing et al. | 354/323 X |
| 4,739,375 | 4/1988 | Kuzyk et al. | 354/69 |
| 4,751,541 | 6/1988 | Goertz et al. | 354/330 X |
| 5,023,643 | 6/1991 | Lynch et al. | 354/323 X |
| 5,081,749 | 1/1992 | Brady | 24/577 |

FOREIGN PATENT DOCUMENTS

| | | |
|---|---|---|
| 3002450 | 1/1980 | Germany . |
| 3018954 | 5/1980 | Germany . |
| 3023993 | 6/1980 | Germany . |
| 3023953 | 6/1980 | Germany . |
| 3023497 | 6/1980 | Germany . |
| 3039195 | 10/1980 | Germany . |
| 3102074 | 1/1981 | Germany . |
| 3101706 | 1/1981 | Germany . |
| 3113464 | 3/1981 | Germany . |
| 3143635 | 4/1981 | Germany . |
| 3208968 | 3/1982 | Germany . |
| 3207723 | 3/1982 | Germany . |
| 3218890 | 5/1982 | Germany . |
| 3223706 | 6/1982 | Germany . |
| 2951616 | 3/1983 | Germany . |
| 3342612 | 11/1983 | Germany . |
| 3407105 | 2/1984 | Germany . |
| 0076869 | 6/1985 | Germany . |
| 3941492 | 12/1989 | Germany . |

OTHER PUBLICATIONS

Jobo Labortechnik "For Your Best Image" Brochure.

Morco Professional Photographic Products "Photo–Therm Automatic Film Processors" Brochure.

*Primary Examiner*—D. Rutledge

*Attorney, Agent, or Firm*—Kolisch, Hartwell, Dickinson, McCormack & Heuser

[57] ABSTRACT

A self-contained photo developing machine is provided. The apparatus includes a developing canister which holds the photo processed material on a central shaft, a compact manifold injection structure which infuses the attached canister with the developing solutions, a valving structure which provides the selected developing solutions to the manifold injection structure, a drain assembly which evacuates the used developing solutions from the canister for seperation and recovery of the different chemicals used, and a computer control system which selectively and automatically controls the entire developing process. A radially extending arm is often included to selectively pump the desired chemical from the solution storage tanks to the canister and subsequently evacuate the spent chemicals to an independently selectable solution recovery tank.

22 Claims, 7 Drawing Sheets

180a
180b
180c
180d
180e
180f
182
185
184
184
200
166
202
172
114
116
166
170
171
90
92
34
188
182
185
184
157

AUTOMATED PHOTO DEVELOPING MACHINE

BACKGROUND OF THE INVENTION

The present invention relates generally to a self-contained photo developing machine. More particularly, the invention concerns a compact and efficient high-quality commercial film processor that automatically supplies the required chemical processing solutions to a detachable film-containing canister to effect development of the particular type of film used and is then able to dump the spent chemicals into any one of a number of selectable solution recovery tanks.

Prior art devices have provided an automated system for developing photographic material whereby different chemicals are delivered and then evacuated from a developing chamber in timed intervals. One such machine is disclosed in U.S. Pat. No. 4,586,805 to Bockemühl-Simon et al., for DEVICE FOR DEVELOPING OF PHOTO MATERIAL, issued May 6, 1986. Other known processors include U.S. Pat. No. Re. 34,188 (of original U.S. Pat. No. 4,890,131) to Kuzyk et al., for AUTOMATIC FILM PROCESSORS, reissued on Mar. 2, 1993, and U.S. Pat. No. 5,023,643 to Lynch et al., for AUTOMATIC PHOTO PROCESSOR, issued Jun. 11, 1991. While these known machines are adequate for their intended purposes, they tend to waste much of the expensive and dangerously corrosive photo processing chemicals that are utilized during the developing process. Additionally, none offer the flexibility to automatically and individually recover the used chemicals in selected waste tanks. Finally, other known devices which use a single tube to deliver different chemicals to the developing canister have a high carryover contamination from residue left in the tube by chemicals used in the previous step in the developing process.

The present invention minimizes, and in some cases eliminates, these problems existent in previously known film developers by providing a unique solution delivery and recovery system to give the user an extraordinarily flexible and efficient automated photo-processing machine. It is thus an object of the present invention to provide a film developing machine which overcomes the drawbacks and limitations in the prior art proposals. More specifically the invention has the following objects: 1) to provide an automated photo developing machine which attains even-mixing of the developing chemicals with the film within the canister to decrease differential development; 2) to locate the chemical injection sites immediately next to the film to decrease the chemical overhead resulting from waste of chemistry; 3) to provide an easily transportable light-tight container which may be loaded with unprocessed film in a darkroom or film bag and then connected to the remaining portion of the processing machine in a normally lighted room without exposing the film; 4) to provide the operator of the photo-processing machine with complete control in selecting the container from which a chemical is to be pumped and, independently, where the chemical will later be dumped and recovered; 5) to allow the operator to easily collect spent processing chemicals in separate containers for recycling or disposal purposes; 6) to keep all utilized solutions within the machine or developing canister for simpler maintenance and clean-up; and 7) to provide for a continuous, efficient wash system which decreases the chance of chemical contamination from prior processes.

SUMMARY OF THE INVENTION

The system of the present invention includes four primary structures: a developing canister which holds the photo-processed material on a central shaft, a compact manifold injection structure which infuses the attached canister with the developing solutions, a valving structure which provides the selected developing solutions to the manifold injection structure, and a drain assembly which evacuates the used developing solutions from the canister for separation and recovery of the different chemicals used. A computer control system is normally also provided which selectively and automatically controls the entire developing process.

The light-tight developing canister is uniquely constructed to provide a daylight assembly which can be removed or stay attached to the manifold injection structure for the convenience of the operator. Undeveloped film is loaded on developing reels or sheet film holders of the conventional type in a darkroom environment. A removable end cap on the cylindrical canister is removed to expose a cavity containing a removable, central shaft extending along the axial length of the canister. The shaft has a preferably square cross-section, but may be any shape to affect a tight non-slipping fit with the reels. The reels are then slid onto the shaft and pushed to the opposite end of the canister. In its preferred embodiment, the canister is exactly dimensioned to receive a whole number of standard reels in order to minimize wasted chemical overhead. Dummy spacers may also be fitted onto the shaft to take up space unused by the loaded reels. It will be appreciated that the canister is further dimensioned to keep the inserted reel suspended off of the bottom of the cavity when the film reels and sheet film holder are fitted on the shaft. This allows improved performance during processing because developer chemicals can be directed with force in an arc to the remote end of the canister to then backwash to the proximate end within this clearance space for easy, even mixing throughout the cylinder. Additionally, this setup improves the dump drainage of the canister through a gravity drain when the chemicals are later evacuated.

Opposite the end cap is the mounting surface of the canister on which is placed a shutter which may be operated manually or automatically. Preferably, this shutter is a double leaf type having an arc when opened extends greater than one hundred and eighty degrees (>180°). The large arc double leaf shutter provides both an opening through which developing chemicals can be injected into the canister and a passage for displaced air to easily escape from as will be explained further in the specification.

The fully loaded canister, when light-tight, may then be removed from the darkroom environment and attached to the developing apparatus adjacent the manifold injection structure. A central shaft end projects out from the mounting surface of the canister and is shaped to easily mate into a receiving hole located on the manifold injection structure of the photo processor. The receiving hole is connected to a drive shaft and a drive motor. When the photo processing machine is turned on, the drive motor undergoes a constant idling which rotates the receiving hole in reversing arcs. This drive system provides the connected canister with a constant reversing agitation during processing for decreased differential development. An appreciated additional advantage of the constant idling is increased ease with which the preferred square center shaft end may be fitted within the square receiving hole. Furthermore, the edges of the shaft end may be increasingly rounded toward its tip to further ease insertion into the receiving hole.

Once the canister abuts the injection structure, it may be secured by means of a latch located on the structure to clamp the canister to the injection structure surface to provide a positive seal therebetween. This seal is light- and water-tight so that the canister shutters may be opened to expose the canister cavity to fluid injection openings located on the injection surface without fear of exposing the film. Manually or automatically opened, the shutters allow chemicals to be injected into the cavity without fear of leakage to the outside environment through the space between the mounting surface and injection surface abutment. This fit is facilitated by an O-ring seal embedded within the abutting injection surface. In this way, the invention provides a completely sealed, dry and mess-free developing process.

Once the canister is attached to the manifold injection structure, a valving structure may be operated to deliver the required chemical processing solutions. The photo processing chemicals are housed in chemical storage tanks fitted with a tank heater subsystem to maintain the chemicals at a desired temperature. The chemicals are selected by operation of a computer controller with special software to communicate to a radially extending valve which is rotationally positionable over a multiplicity of air inlets and chemical dump holes. During a pumping cycle, internal air compressors force external air or nitrogen through an inlet in the radially extending valve arm and into a selected chemical tank. The pressurized chemical tank then forces the selected chemical up a hose and to a connection on the side of the manifold injection structure.

Once the selected chemical is delivered to the manifold injection structure, it is passed through a nozzle within the structure and down and out a passage into the canister developing area. Wash water can then be provided to the passages within the injection structure to purge the system of chemical residue and prepare the machine for the next step in the developing process. The nozzles which pass the chemical processing solutions to the internal passages within the injection structure preferably have a smaller diameter than the passages to allow for lower back pressure and provide for space below the nozzles for wash water injection apertures. This is critical to cleaning in later steps and does not allow the chemicals to back flow into the water injection apertures which would contaminate subsequent processing steps.

The manifold injection structure is preferably fitted on its canister abutting surface with a number of elements, including a pressure sensor, temperature sensor, air overflow vent, chemical overflow port and a dump valve. The chemical level within the canister is sensed with a pressure sensor defined on the abutting surface of the injection structure adjacent the canister developing area. When the appropriate fluid height is sensed within the canister, the pumping pressure into the chemical tank is turned off by breaking the connection between the air compressor and the chemical tank. The broken connection depressurizes the storage tank, thus stopping the flow of chemical.

During the injection of chemicals into the chamber, air must be vented for the pressure sensor to properly measure chemical levels within the chamber. This is accomplished by placing the arc of the canister shutter opening above the level of the fluid. This allows the canister to be vented through the highest arc of the shutter and out through a light-tight air overflow vent located on the abutting surface of the manifold injection structure to the atmosphere.

A chemical overflow port is placed central to the manifold injection structure and just above the center where the drive shaft is engaged. The chemical overflow port provides a path into a back section of the injection structure and joins with two passages out the side of the structure. This overflow port prevents excess chemicals from being spilled into a common splash tray below the manifold injection structure. It also allows a continuous wash cycle to occur within the exteriorly dry canister, a feature not disclosed in prior art photoprocessors.

During the wash cycle, water enters a pipe within the manifold injection structure fitted with multiple dispensing apertures. These apertures lead to the individual chemical passages as well as to an area above the chemical overflow port. The individual chemical passages are cleaned as the water passes into the canister film developing area. This provides for exceptional clearing of all chemicals that could be carried over to the next step. The passages above the overflow port are very close to the canister mounting surface (preferably within 0.03"), which provides for a "sheet washing" effect over the area between the canister and the injection structure. This very shallow canister-to-injection structure gap also decreases the chemical overhead by presenting as little wasted space as possible. Various types of washes are provided whereby the tempered wash water can be supplied by an internal tank or by an external water source. Examples of wash protocol include 1) fill and dump, 2) fill and hold and 3) continuous wash.

A probe for sensing the temperature of the chemicals during the processing cycle is located in a port near the film developing area which offers a high degree of agitation. If the temperature of certain critical chemicals deviates from a known standard, then more or less time can be provided for that chemical step. The computer controller calculates the compensation based on a "drift down algorithm." This in turn provides for more consistent processing results and eliminates the need to provide a heating element within the canister to maintain a constant desired temperature.

A dump valve, mounted at the lowest point in the developing area and central to the head, provides for the passage of spent chemicals and wash water after the end of each step. The dump chamber occupies an extremely small portion of the chemical overhead. Prior to dumping, the computer controller rotates a radially extending valve across a horizontal arc and positions it over a selected solution recovery pipe opening. When the valve is activated, chemical flows out of the developing area through a gravity drain, and down a passage to the radially extending valve. The dumped solution then passes down the arm of the radially extending valve and out the rotating end into the selected recovery pipe opening to then be carried to one of a plurality of solution recovery tanks. The system provides an operator the capability to select a number of solution recovery pipes to which spent chemicals are dumped after use. For instance, an operator may select to dump chemical A not only in solution recovery tank A, as prior art machines are limited to, but the chemical may also be selectively dumped into tanks B through F as well.

DETAILED DESCRIPTION OF THE PREFERRED EMBODIMENTS

Figure 1:
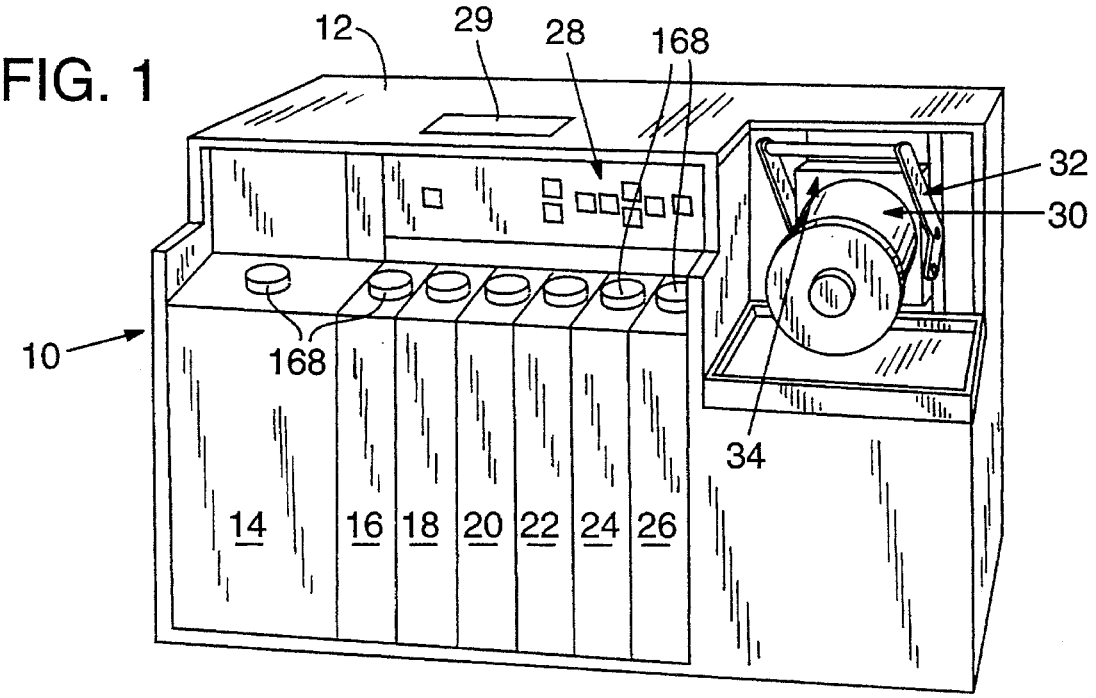
FIG. 1 is an isometric view of the exterior of the preferred embodiment of the present invention.

The compact film developing system 10 of the preferred embodiment is in the form of a compact, integral box 12 which contains an array of tanks or liquid supply cells 14, 16, 18, 20, 22, 24 and 26, shown best in FIG. 1. Cell 14 is larger than the others because it is designed to hold wash water, while the other cells contain chemicals or chemistry used for film processing. Each of the cells 16, 18, 20, 22, 24 and 26 typically includes a single heating element (not shown) in the form of a glass covered heating rod which is connected to a 12-volt source to maintain the temperature of the chemistry in the various cells. Three such heating elements (not shown) are typically included in cell 14 to heat and then maintain the wash water temperature. Conventional temperature sensors are disposed in the tip of each of the heating elements to sense the temperature of the wash water and the chemistry, and to cause the system to heat the fluids as necessary.

An information and control panel is depicted generally at 28, and includes various control and readout features. Behind panel 28 is a micro processor or computer 29 which is used to record data and to control the operation of the system 10. This computer will be described in detail below.

System 10 utilizes is a film canister depicted generally at 30 which is designed to hold the film (not shown) that is to be developed. Canister 30 is removably held in box 12 by a latch mechanism shown generally at 32. An injection manifold 34 directs processing fluids in and out of canister 30 as desired by the operator and as controlled by the automated control system described below.

Figure 2:
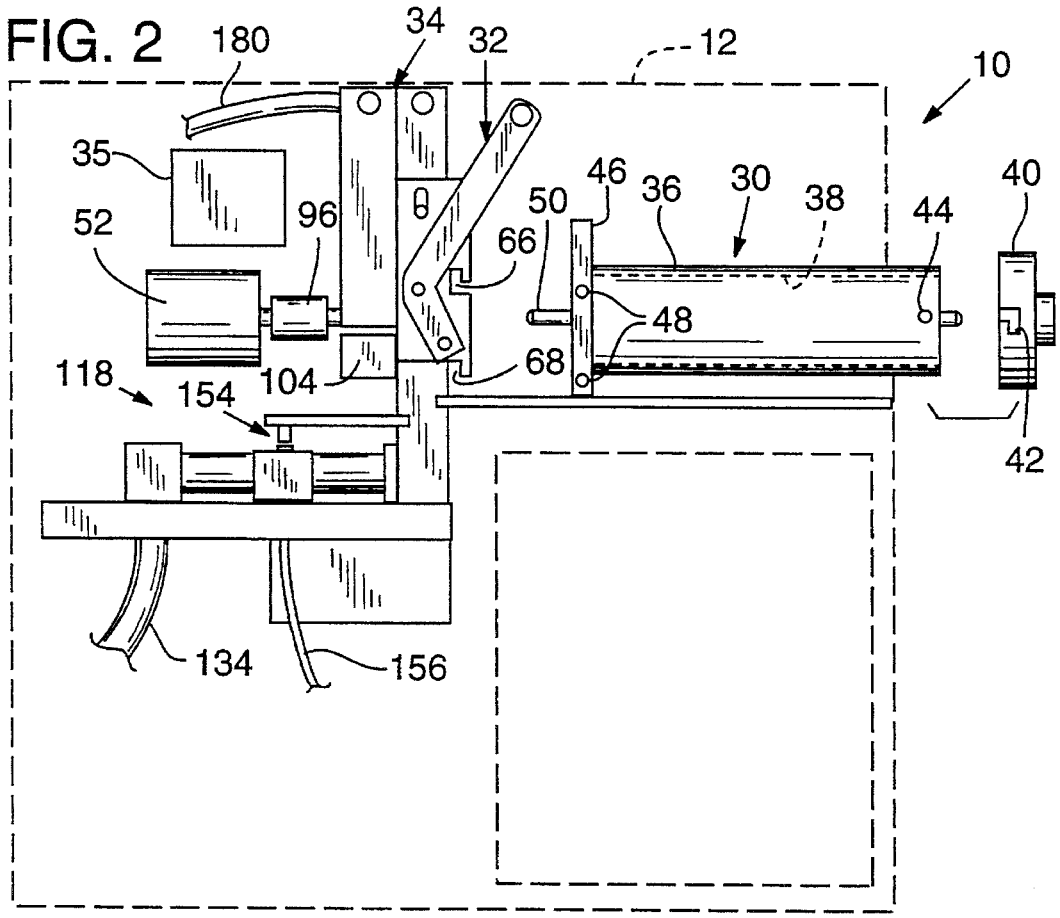
FIG. 2 is a side elevation, simplified view of the embodiment of FIG. 1.

As shown best in FIG. 2, canister 30 includes, in this preferred embodiment, a generally cylindrical tube 36, although it should be recognized that the canister could take any number of other configurations. Canister 36 defines a central cavity 38 designed to receive film mounted to film reels. Mounted to the distal end of tube 36 is a canister end cap 40 which includes three circumferentially-spaced L-shaped slots 42 (only one of which shows in FIG. 2), and three corresponding end cap mounting pins 44 (again, only one of which is shown in FIG. 2). End cap 40 typically also includes a spring biased end plate (not shown) which faces tube 36 so that as the end cap is positioned on its mounting pins 44 and the mounting pins are pressed into the mounting slots 42, the springs cause the end cap to fit tightly against the tube in a water- and light-tight fit.

At the proximal end of canister 30 is a canister mounting plate 46 which includes four canister mounting pins 48 (only two of which show in FIG. 2). Canister mounting pins 48 are designed to be received by a latch mechanism 32, to be described below.

Extending centrally through canister 30 is an agitation drive shaft 50 which, in the preferred embodiment, is square in cross section and which is provided with drive power by drive motor 52. Power is provided from drive motor 52 to drive shaft 50 through a drive engagement mechanism which will be described below but which is not shown in FIG. 2. Drive shaft 50 extends from the drive engagement mechanism through tube 36 and is rotationally engaged by a shaft receptor (not shown) centrally disposed in the inwardly facing end of end cap 40.

Drive motor 52 is a 12 volt D.C permanent magnet gear motor that is controlled by computer 29. The computer uses back-EMF from the motor in a closed-loop control circuit to set motor speed. The operator can program one of several discreet speeds for each step of a developing process. The drive motor also periodically reverses to enhance processing uniformity. In operation, drive motor 52 idles at its minimum speed of 6 rpms whenever system 10 is on, but is not running through a process. This facilitates easy engagement of the spindle when loading a canister.

Figure 8:
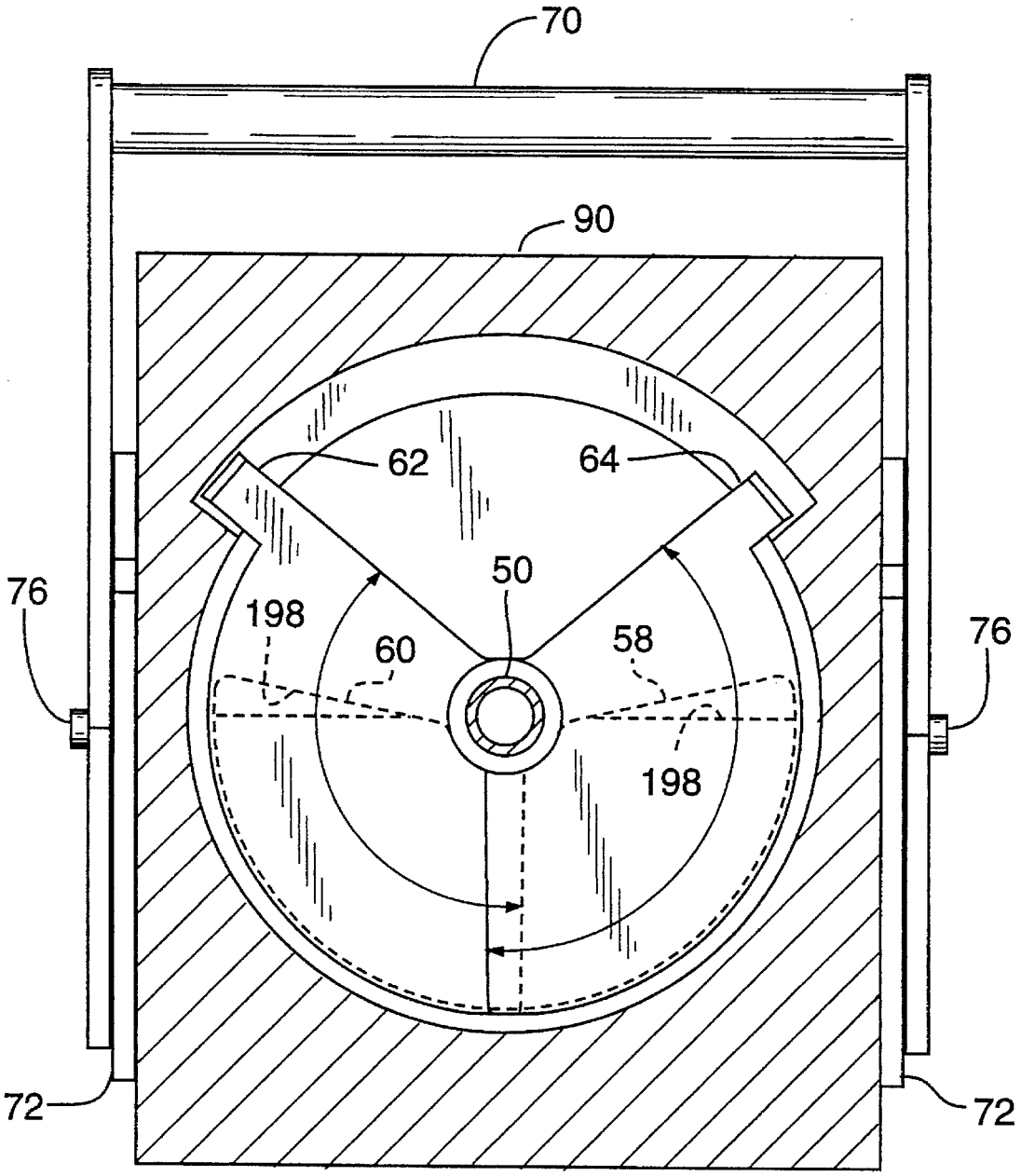
FIG. 8 is a front elevation sectional view taken along line 8—8 of FIG. 6.

As shown best in phantom in FIG. 8, the proximal end of canister 30 includes a butterfly valve with double leaf shutters 54 and 56. These shutters 54, 56 are designed to selectively cover this proximal end of canister 30, which also includes a pair of wedge-shaped openings 58 and 60, each of which define an opening of somewhat more than 90 degrees, preferably 95 degrees. Thus, the lower portion of this end of canister 30 is open to the injection manifold 34 to which it will be mounted. As will be described below, this opening is necessary in order to permit processing chemistry and wash water to be injected into the canister. With shutters 54, 56 in their lower, closed positions, the canister will be light-tight.

As best shown in FIG. 8, each of the double leaf shutters 54, 56 is rotationally mounted into the end of canister 30, and they are each provided with a control ear 62, 64, respectively, which extends radially outwardly and which may be controlled even with canister 30 being held tight against injection manifold 34 by latch mechanism 32. With this design the canister may be mounted into position with the shutters closed, and the shutters can then be opened. While in the depicted embodiment the control ears are shown to be manually operable, they could well be designed to be opened with a single lever or be automatically controlled by computer 29.

Figure 5B:
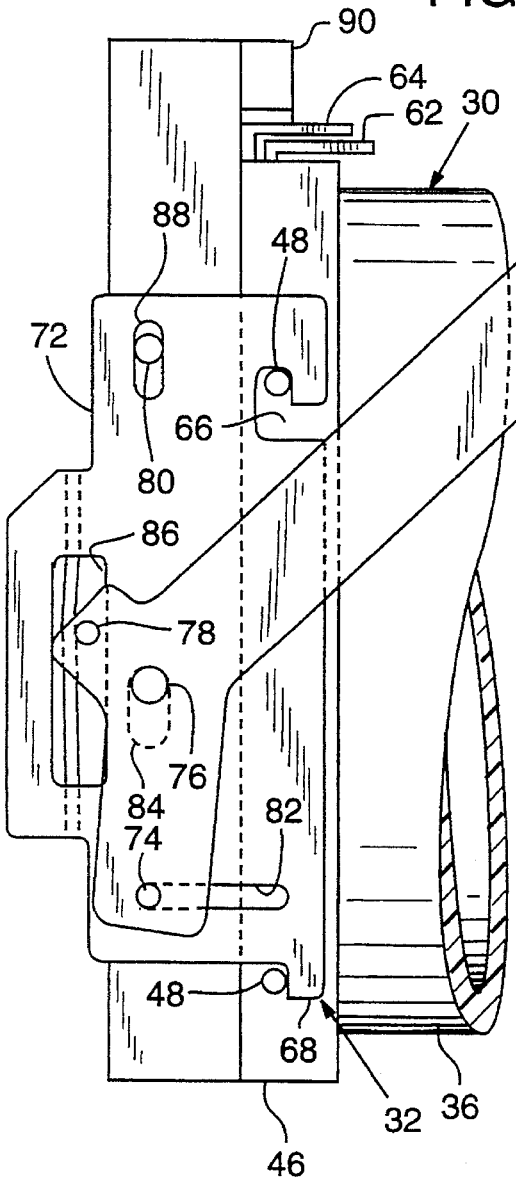
FIG. 5*b* is a fragmentary view of the canister mounting system of the preferred embodiment of FIG. 1, with the latch in the engaged position.
Figure 5A:
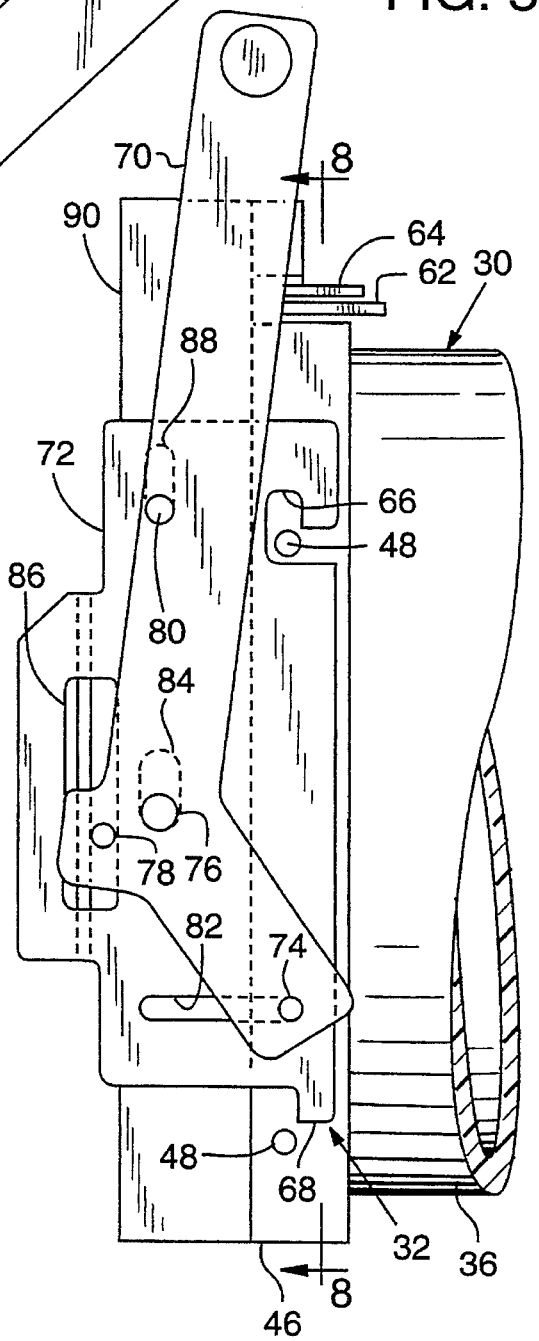
FIG. 5*a* is a fragmentary view of the canister mounting system of the preferred embodiment of FIG. 1, with the latch in the disengaged position.

The latch mechanism, shown generally in FIGS. 1 and 2 at 32 but best shown in FIGS. 5*a* and 5*b*, will now be described. This mechanism 32 serves to removably mount canister 30 to injection manifold 34 in a liquid- and light-tight fit. As described above, canister mounting plate 46 includes a pair of mounting pins 48 at each side thereof. These mounting pins 48 are designed to be received in a pair of L-shaped canister mounting slots 66, and a pair of downwardly extending mounting flanges. Thus, as shown in FIG. 5*a*, when the canister is pushed into its mounted position, the upper pair of mounting pins 48 are received in mounting slots 66, and the lower pair of mounting pins 48 are directed past mounting flanges 68. In order to engage canister 30, latch lever 70 is manually pivoted downwardly, as shown in FIG. 5*b*. This pivoting of latch lever 70 causes the downward movement of a latch plate 72 as a result of the positioning of latching pins 74, 76, 78 and 80 which extend through latching slots 82, 84, 86 and 88, respectively, in latch plate 72. As shown in FIG. 5*b*, as latch lever 70 is pivoted downwardly, latch plate 72 moves with it, thereby causing canister mounting slots 66 and canister mounting flanges 68 to engage the upper and lower pair of canister mounting pins 48, respectively. Pins 74 and 78 extend from latch lever 70, while pins 76 and 80 extend from a forward portion 90 of injection manifold 34. As will be discussed below, the injection manifold is comprised of both a forward portion 90 and a rear portion 92 (not shown in FIGS. 5*a* and 5*b*).

Figure 6:
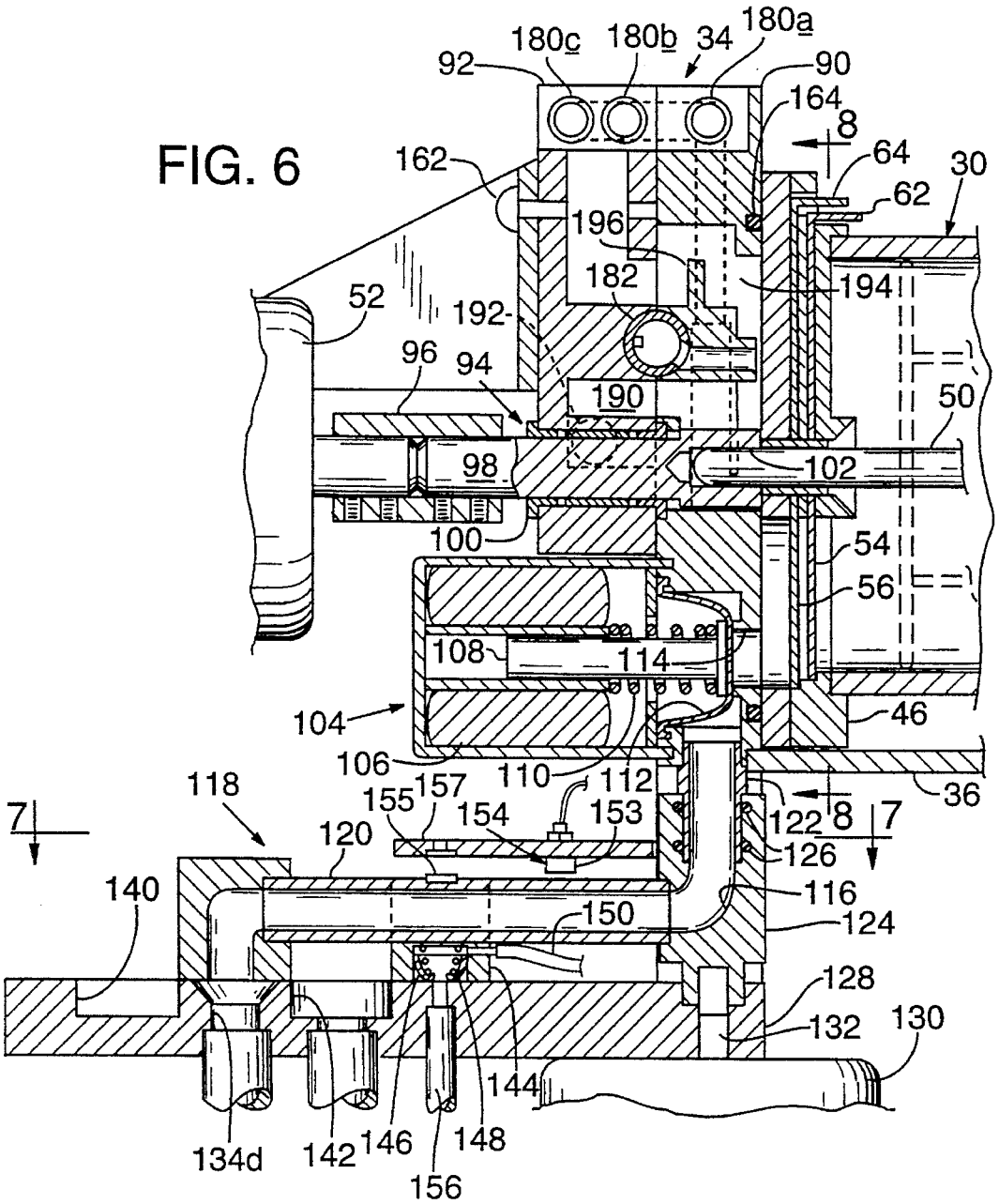
FIG. 6 is a side elevation sectional view taken along line 6—6 of FIG. 3.

As mentioned earlier, drive motor 52 provides rotational power to drive shaft 50 via a drive engagement mechanism, which is best shown in FIG. 6 and is indicated generally with the numeral 94. It includes a removable coupling 96, and a coupling shaft 98 which extends through rearward portion 92 of injection manifold 34 via a bushing system 100. In the preferred embodiment, three bushings and an O-ring seal are actually included. Coupling shaft 98 includes a female portion or shaft receptacle 102 which is square in cross section to permit removable insertion of square drive shaft 50.

Figure 3:
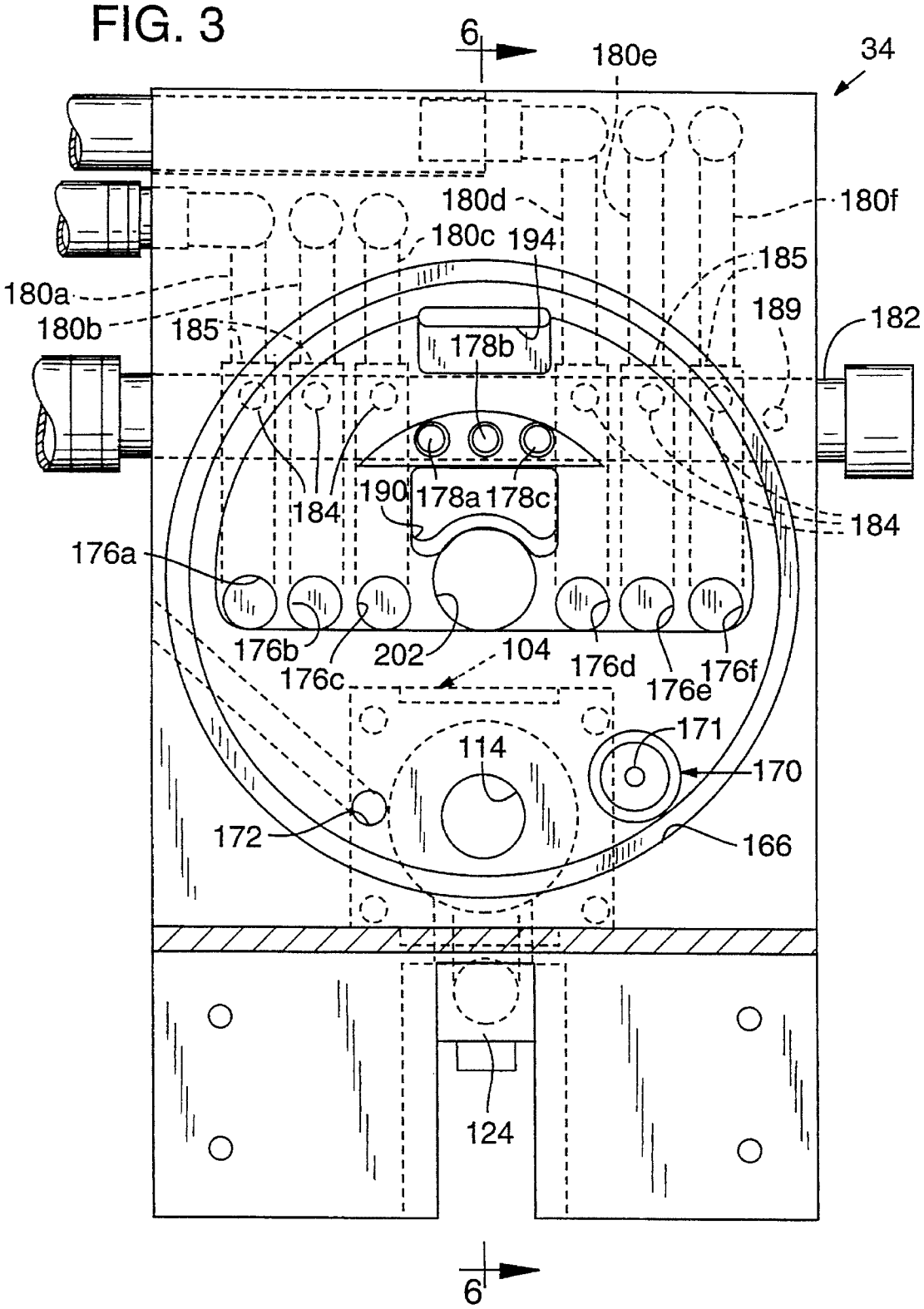
FIG. 3 is a fragmentary, front elevation view of the injection manifold of the embodiment of FIG. 1.
Figure 4:
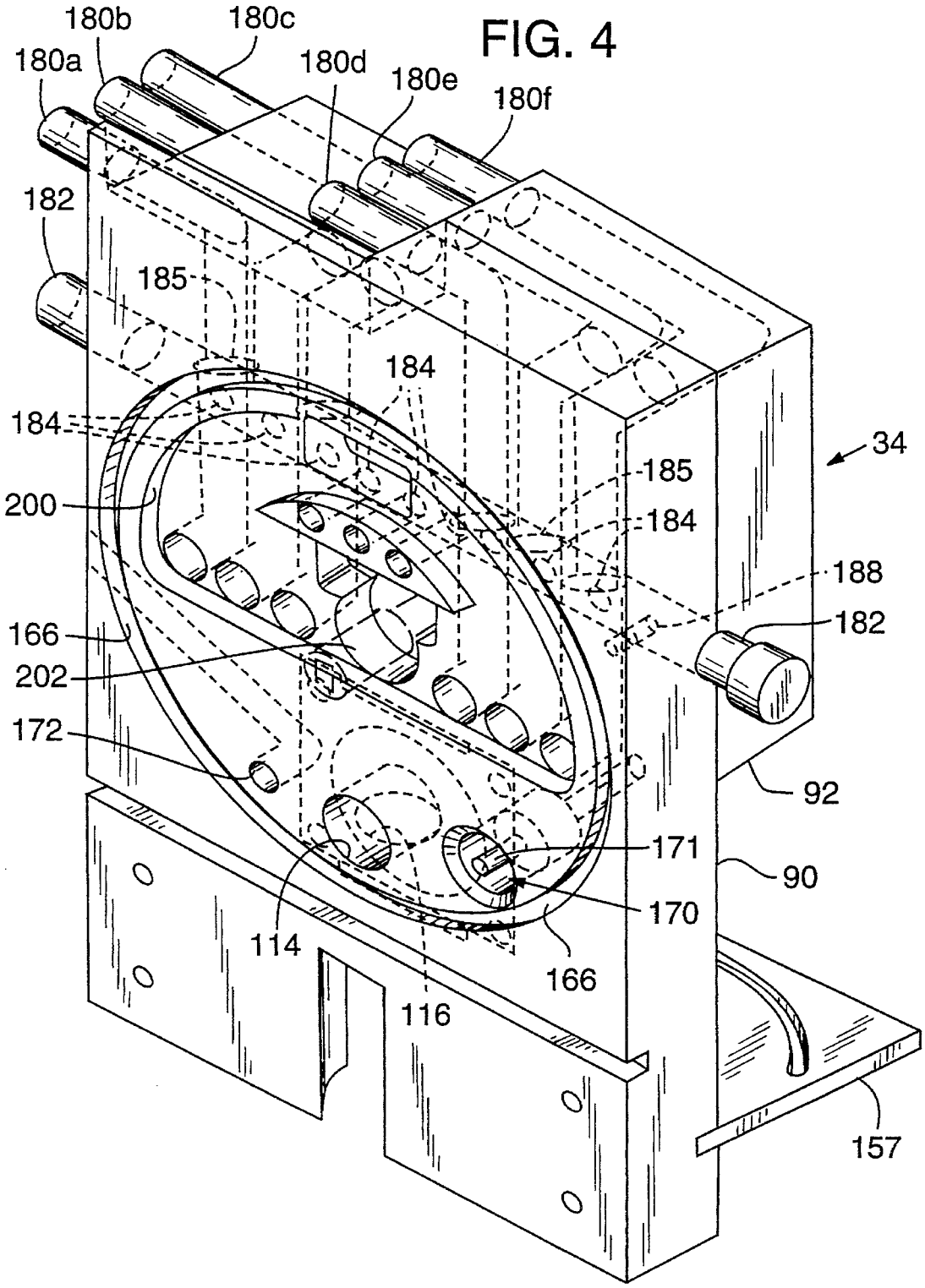
FIG. 4 is an isometric view corresponding to FIG. 3.

As shown schematically in FIG. 2 and in detail in FIG. 6, the system further includes a dump valve 104 which controls the draining of developing chemistry and wash water from canister 30. Dump valve 104 is in the form of a solenoid valve including a solenoid coil 106, a solenoid shaft 108, and a spring 110 which biases the shaft outwardly or toward its closed position. Solenoid shaft 108 extends against an elastomeric seal 112 which seats against a drain aperture 114 in the forward portion 90 of injection manifold 34. Drain aperture 114 is also shown in FIGS. 3 and 4. FIG. 6 shows dump valve 104 with solenoid shaft 108 in its forward position, thereby closing drain aperture 114. In this position the solenoid coil 106 is not provided with electrical power. In order to open dump valve 104, computer 29 sends a signal through an external driver to the solenoid, thereby energizing magnet 106 and causing shaft 108 to be drawn back into the solenoid. This causes elastomeric seal 112 to be pulled off of drain aperture 114, permitting fluid to drain out of canister 30. In order to activate the solenoid and thereby open dump valve 104 in the preferred embodiment, a 12-volt charge is sent to the solenoid to cause it to shift into its withdrawn, open position. Once solenoid shaft 108 has been withdrawn, the charge is reduced to somewhat less than 3 volts to maintain it in a withdrawn or open position, yet not overheat the solenoid coil 106 so that the valve can be held open indefinitely, if desired.

Figure 7:
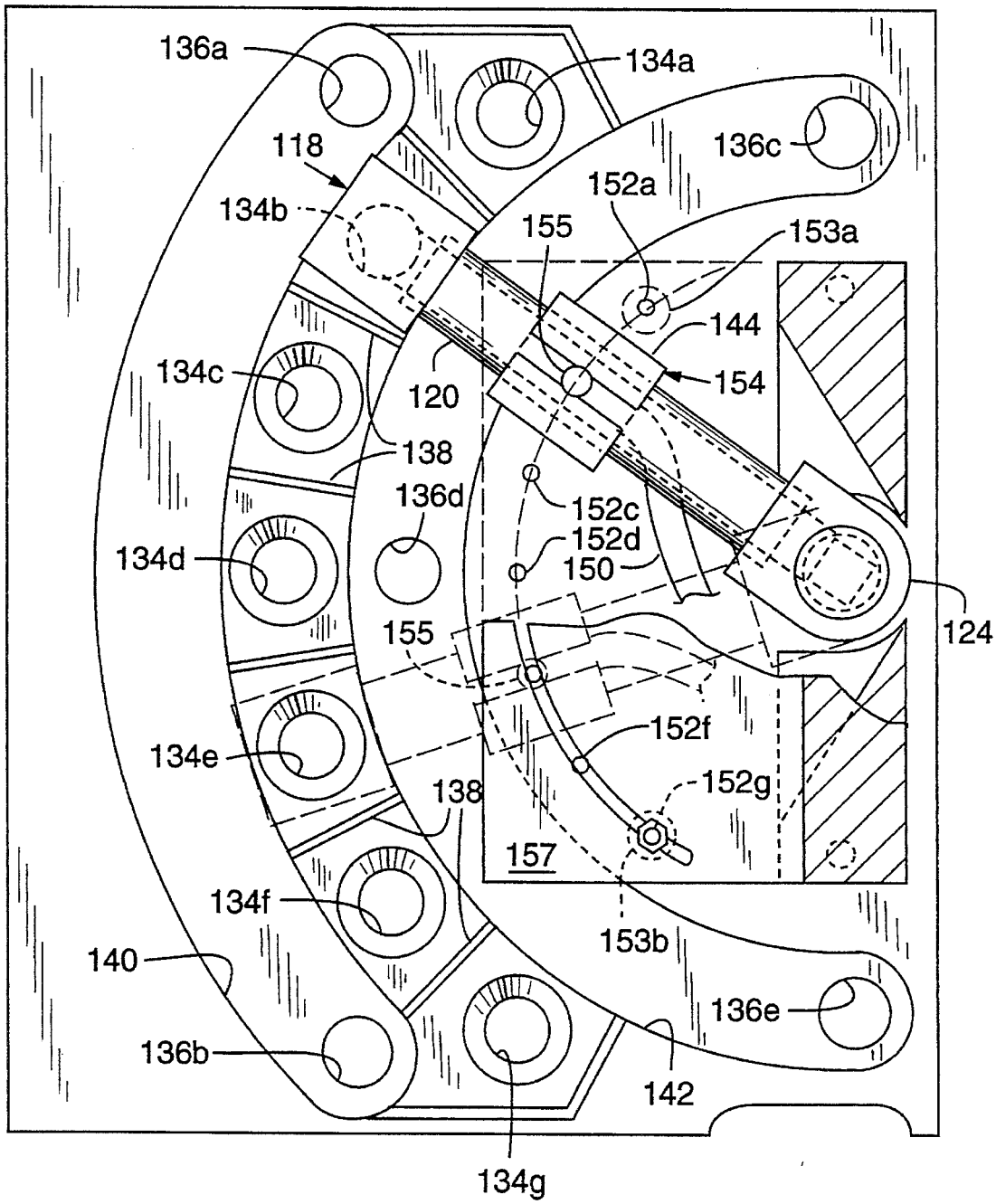
FIG. 7 is a top plan view of part of the control valve system taken along 7—7 of FIG. 6.

Fluid which has drained through drain aperture 114 is allowed to flow by gravity past the opened dump valve 104 and into a drain conduit 116 passing downwardly through and out of the forward portion 90 of the injection manifold. The fluid then passes through a rotatable turret valve indicated generally at 118 in FIGS. 6 and 7. FIG. 7 shows that the turret valve is in the form of a turret arm 120 which is pivotable to a variety of positions within about a 107 degree arc. To prevent leakage between the rotating turret valve 118 and the stationary injection manifold 34, a turret bushing 122 extends downwardly from the forward portion 90 of the injection manifold into a turret shaft 124. A single O-ring is preferably provided between the turret bushing and the turret shaft, although a pair of O-rings 126 are shown in FIG. 6. Turret shaft 124 is rotatably mounted in a turret plate 128 and is driven by a turret motor 130 via a turret drive shaft 132. Turret motor 130 is in the form of a D.C, reversible servo motor of the type used for model aircraft, and is designed to be rotated along a 107 degree rotation path. Alternatively, a geared stepper motor can be substituted for the model aircraft-type servo motor of the preferred embodiment. The operation of the preferred embodiment motor is controlled by computer 29 and the external driver, via indexing information from a so-called Hall sensor system to be described below.

Depending upon the position of turret arm 120, fluid is allowed to drain into one of a plurality of chamfered drain ports 134*a, b, c, d, e, f, g*. These drain ports connect with drain lines to permit processing chemistry and wash water to be dumped to individual containers (not shown) as preset by the operator and as controlled by computer 29. As depicted best in FIG. 7, five overflow drain ports 136*a, b, c, d, e* are provided in the event any of the drain containers are full. Radial drain slots 138, isolating each drain port 136a–*e*, extend between a pair of arc-shaped overflow troughs 140 and 142. Overflow ports 136*a–e* interconnect to one another at a point below turret plate 128 and normally lead to a single overflow container (not shown).

In addition to directing fluid which is draining from the canister, turret valve 118 controls the injection of developing chemistry and wash water into the canister. This is done through an air injection system. A generally U-shaped air seal member 144 is mounted below and travels with turret arm 120, as shown best in FIG. 6. Disposed within the air seal member is an elastomeric air seal 146 which is held in place by seal spring 148 to minimize air leakage as the turret arm moves between its active positions. An air supply 150 extends into one side of air seal member 144 and thereby travels with turret arm 120, and permits air to be directed into the appropriate air hole 152*a, b, c, d, e, f* or *g* (shown in FIG. 7), and then to a hose, such as hose 156 in FIG. 6.

At the appropriate point of the development cycle, when it is desired that fluid from the wash water cell 14 or from one of the chemical supply cells 16, 18, 20, 22, 24, or 26 is to be injected into the canister, air pressure is directed through air supply 150 and air seal member 144, and thereby into the appropriate air hose 156. Each of these air hoses is connected to an upper portion of each of the storage cells. Each cell 14–26 is provided with a cap 168, each cap being tightly fitted to its appropriate cell and normally including a gasket (not shown) to prevent air pressure from being lost through the caps. Thus, by pumping air into an appropriate cell, fluid is forced up and out of the cell, through suitable hoses (not shown), and into canister 30 through injection manifold 34.

As shown in FIG. 7, the position of turret valve 118 determines which cell is going to be pressurized, and therefore which fluid is to be injected. Thus, at the beginning of each step of the cycle, fluid will be injected from one of the chemical storage cells upwardly into the canister, with the turret arm being positioned over the pertinent air hose 156. Because the other air hoses are open to the atmosphere, the fluid will not be pressurized out of any of the other cells. When turret valve 118 is in its dumping mode and dump valve 104 is open, air will not automatically be injected into the radially adjacent air hose 152*a–g* because the air compressor is not always running. That is, computer 29 controls operation of the compressor so that it will only be running when compressed air is needed.

In the preferred embodiment, the system for providing compressed air, depicted schematically in FIG. 2 at 35, is actually a pair of air pumps mounted in parallel. These pumps typically would be diaphragm pumps of the type used in aquariums. Preferably they should provide 4 liters per minute of compressed air flow with zero back pressure, providing a static pressure of 8 psi with zero flow. In the depicted embodiment, a pair of Binaca Products BP 101-9 pumps are utilized. However, a wide variety of other compressed air supply systems could be utilized. For example, system 10 can alternatively include a compressed air bottle (not shown). It is also possible that nitrogen or some other pressurized gas is used to provide the necessary pressure for the system.

As mentioned above, and as best depicted in FIGS. 6 and 7, turret motor 130 is controlled by the system computer 29 through a so-called Hall sensor system 154 which includes a pair of Hall sensors 153*a* and *g*, and a permanent magnet 155, the position of the Hall sensors corresponding to the position of the two outer-most drain ports 134*a* and *g* and air holes 152*a* and *g*. Hall sensor system 154 is used to sense these two extreme positions of turret arm 120, and thereby to give computer 29 two known positions. The five intermediate positions corresponding to drain ports 134*b–f* and air holes 152*b–f* can then be determined by interpolation. Also, since this indexing operation occurs each time the processor is powered on, the working condition of the turret valve is verified. The single permanent magnet 155 is fastened to turret arm 120, and the Hall sensor system 154 detects the leading edge of the field from this magnet. When the turret arm is in either of its two extreme positions over drain ports 134*a* and *g* and air holes 152*a* and *g*, this turret arm magnet 120 is positioned under one of the sensors 153*a* or *g*. The magnet 155 and the Hall sensors 153 appear to be radially offset in FIG. 6 because turret arm 120 is not in its mid-position. As seen in FIG. 7, it is shown to be over drain port 134*b* and air hole 152*b* (not shown). In FIG. 7, a mounting plate 157 over which turret arm 120 swings, is partially broken away so that the turret arm can be better seen. The turret arm is shown in phantom to be positioned over drain port 134*e* and air hole 152*e* (not shown) merely to illustrate that the turret arm takes a plurality of these positions during normal operation of system 10.

Computer 29 implements indexing by sequentially stepping turret arm 120 and monitoring the appropriate magnetic sensor input. When the sensor 153*a* first detects magnet 155 mounted to the turret arm, that is the leading edge of the field. After detecting this first position, the turret arm then scans for the second position at Hall sensor 153*g*. In practice, when both sensors have successfully detected the magnet, the turret arm is set to a default position, ready for service. If either of the sensors fails to detect the magnet during indexing, then a fault condition is reported to computer 29 and the operator is alerted of the malfunction. It is expected that the micro-processor would store past successful indexing information to shorten the indexing cycle and, in the event of a malfunction, would provide backup if reindexing is unsuccessful.

The injection manifold 34 will now be described in more detail. As noted above, the injection manifold includes a front portion 90 and a rear portion 92. They are typically mounted to each other by bolts such as schematically shown at 162. Front portion 90 is adapted to receive canister mounting plate 46 which fits against an O-ring 164 mounted in the front of the front portion in a circular groove 166. This provides a light- and fluid-tight fit between canister mounting plate 46 and the injection manifold. It can be seen in FIG. 6 that the lower portion of canister mounting plate 46 is open to drain aperture 114, so that when the double leaf shutters 54, 56 in the proximal end of canister 30 are open, chemistry or wash water will be permitted to drain through the drain aperture, but only if dump valve 104 is in its open position.

A pair of sensor ports 170 and 172 are provided in the front of the forward portion 90 of the injection manifold, to sense the conditions of the fluid in canister 30. The first of these is a temperature sensor port 170 which includes a thermistor probe 171 which is exposed to the fluid in canister 30, thereby obtaining an accurate reading of the temperature of the fluid during processing operations. The thermistor probe 171 can then send a signal to the system computer 29 to let it know whether additional or decreased processing time will be needed because an insufficient or excessive fluid temperature, respectively, exists within the canister.

Pressure sensor port 172 accesses fluid pressure in the canister, and this pressure is remotely sensed by a pressure sensor (not shown) which is normally positioned behind information control panel 28. Pressure is conveyed to the pressure sensor by an angular tube shown in FIGS. 3 and 4. It was found that by remotely positioning the pressure sensor, accurate readings can be taken, while protecting the sensor. In the preferred embodiment the pressure sensor is of the silicon piezoresistive type, Motorola Model No. MPX10GP, and can sense pressures between 0 and 1.5 psi. Measurement of the pressure in canister 30 permits a calculation of the level of fluid therein, so that the operator-selected level of fluid is initially pumped in and maintained.

FIGS. 3 and 4 also depict nine different fluid injection ports which are designed to inject fluid under pressure into canister 30. Ports 176*a, b, c, d, e* and *f*, are all designed to inject either developing chemistry or wash water into the canister through the open lower half of canister mounting plate 46 and through the open double leaf shutters 54 and 56 (see FIG. 8) in the end of canister 30. Three centrally disposed water injection ports 178*a, b*, and *c* are also provided, but these ports are different from fluid injection ports 176*a–f* because the water injection ports are only used to inject wash water. As noted above, fluid injection ports 176*a–f* can be used to inject either developing chemistry or wash water.

As shown best in FIG. 6 at 178, water injection ports 178*a–c* are spaced rearward slightly from canister mounting plate 46 (here by approximately 0.03") so that wash water passing through them fans out over the interface area between the front portion 90 of the injection manifold and the canister mounting plate. That wash water will then join the wash water being injected into the canister from fluid injection ports 176*a–f*. As shown best in FIGS. 3 and 4, each of the fluid injection ports 176*a–f* is connected to its own chemical supply line 180*a, b, c, d, e* or *f*. These lines each extend from a separate chemical supply cell 16, 18, 20, 22, 24 or 26, although the lines 180*a–f* are shown schematically in FIG. 1 as a single line at 180. They each enter either the front or rear portion of injection manifold 34 and then turn vertically or downwardly in alignment with their respective fluid injection port 176*a–f*. At approximately the midpoint of the vertical portion of each of these chemical supply lines 180*a–f* is a wash water supply tube 182 which includes a plurality of apertures 184 therein which interconnect the wash water supply tube with the downwardly extending chemistry supply lines 180*a–f*. At a point slightly above where the wash water supply apertures access the chemical supply lines, the lines are stepped at 185. This results in a drop in pressure in each of the lines, which prevents water from passing upwardly into the chemistry supply lines, which might cause contamination of the chemistry in the chemistry supply cells.

Wash water supply tube 182 is interconnected with wash water cell 14 so that wash water is provided under pressure through this tube. Because water injection ports 178*a–c* are not interconnected with any of the chemistry supply lines 180*a–f*, water, and water only, will pass through these ports.

As shown best in FIG. 4, wash water supply tube 182 is, in the depicted embodiment, a removable tube which has apertures drilled into it and which is held in position by a dowel pin 188 (see FIGS. 3 and 4). The tube thus cooperates in not only insuring proper delivery of chemistry and wash water, but it also assists in alignment and mounting of the front and rear portions 90 and 92 of the injection manifold to each other.

Also provided in the injection manifold is an overflow duct 190 which extends through the center of both portions of injection manifold 34, as shown best in FIGS. 3 and 4. This is provided, as the name implies, to receive fluid in the event of an overflow condition in canister 30. Overflow duct 190 is interconnected with an overflow conduit 192 which dumps the overflow fluid to a remote container.

The overflow can also be used for a constant wash cycle in which compressor 35 would be more or less constantly running (or the system would be hooked up to a compressed air source) to provide a constant feed of wash water through ports 176*a–f* and 178*a–c*. In this cycle there would be a constant overflow as the wash water constantly flushes through the canister. This type of cycle is helpful when archival-quality film is being developed, to insure elimination of any chemistry or impurities in the canister or on the film.

Finally, an air vent 194 is provided in injection manifold 34 to permit air to enter and exit the canister as chemicals and water are pumped into and drained from canister 30. As shown in FIG. 6, this air vent directs air around a light baffel 196 and then out through the top of rear portion 92 of the injection manifold. This circuitous path prevents light from entering the canister.

As suggested earlier, air is permitted to leave canister 30 through the angular slits 198 which result from the double leaf shutters 54 and 56 and the apertures behind them extending slightly beyond horizontal. Because fluid will not exceed approximately the midway level point of the canister (which corresponds to the lower edge of overflow 190), air will be free to pass through these slits, and then through a substantially semicircular recessed portion 200 in the forward portion 90 of the injection manifold, as shown best in FIG. 4. From this recessed portion, the air can pass into air vent 194, up around light baffel 196, and then up through the top of the rear portion 92 of the injection manifold.

To complete the description of FIGS. 3 and 4, a cylindrical opening 202 is provided to receive a shaft bushing 100 and coupling shaft 98 as described earlier. This cylindrical opening 202 is, as shown in FIG. 6, set substantially back from the front of the front portion 90 of the injector manifold.

The computer 29 has been only mentioned above, but will now be discussed in more detail. In actuality, two microprocessors are incorporated into the preferred embodiment. The main system computer 29 controls most computer operations while a second dedicated unit controls turret valve 118. The main computer is an Intel type 8052-BASIC unit equipped with external RAM, program EPROM, NVRAM (non-volatile memory) and peripheral interface circuitry. The second computer is a Motorola MC68HC705K1 microcontroller, dedicated to controlling the turret valve, under the supervision of the main computer. The MC68HC705K1 is located on a PCB (printed circuit board) that also contains circuitry for the dump valve driver and the compressor driver.

The main computer and its microprocessor were originally developed for the Wing-Lynch Model 5 Processor and provide overall processor control including operator interface, process timing, temperature control, error checking, process memory, etc. The preferred embodiment disclosed herein was designed so that only the firmware inside the computer EPROM needed to be changed between models of processors. No other computer changes were required.

The MC68HC705K1 is a dedicated microcontroller with internal program memory that indexes the selector valve on power-up, reports an error condition to the main computer if indexing fails, moves the selector to one of seven valve positions on command from the main computer and takes care of other minor selector operations. The MC68HC705K1 controls turret valve position by generating a pulse width signal that is compatible with model aircraft type servo motors.

Operation of the Preferred Embodiment

An example of a complete development process will now be provided. This is a standard so-called C-41 color negative process.

| PROCESS | TIME (MIN:SEC) |
|---|---|
| Presoak (using wash water) | 2:00 |
| Developer | 3:20 |
| Bleach | 6:30 |
| First Wash (using wash water) | 2:00 |
| Fixer | 6:30 |
| Second Wash (using wash water) | 2:00 |

Before beginning a processing operation, adequate chemistry must be loaded into each of the chemistry storage cells 16–26. The wash water cell 14 is also filled at this time. The heating elements (not shown) in each of the cells are then automatically activated as necessary based upon input from the temperature sensors (not shown) disposed in the heater elements of the cells. The standard processing temperature for both the chemistry and the water is 100.4° F. Drain receptacles should also be positioned below the level of system 10 at this time to hold spent chemistry and wash water.

As the wash water and chemistry is being heated, the film to be processed may be loaded into canister 30. This must be done in a dark environment, such as a changing bag or box, or a darkroom. Roll film is loaded onto conventional developing reels which may be fabricated of metal or plastic, which are then mounted onto drive shaft 50. In the event sheet film is being developed, a sheet film holder would be provided. If the film to be developed does not fill the length of canister 30, a cylindrical spacer should be added to prevent the reels or holder from washing back and forth with the injection and dumping of the processing fluids, and to conserve chemistry. Alternatively, the length of canister 30 can be shortened to accommodate fewer film reels or sheet film holders.

The shaft-mounted reels (not shown) are then mounted in canister tube 36, by mounting end cap 40 to the end of tube 36 through the use of end cap mounting slots 42 and pins 44. Shutters 54 and 56 are then closed, and the canister is light-tight for transport to the processor.

The unit is turned on at the information and control panel 28, and turret valve 118 performs a self-calibration operation by Hall sensors 153*a* and *g* which sense the position of magnet 155 as turret arm 120 swings from side to side. The turret arm then goes to a predetermined default position, and turret motor 130 awaits instructions from computer 29.

Latch lever 70 is then raised to the position shown in FIG. 5*a*, canister mounting plate 46 is pushed into position and latch lever 70 is lowered as depicted in FIG. 5*b*. This engages canister 30, and provides a fluid- and light-tight seal between canister mounting plate 46 and forward portion 90 of injection manifold 34. Once the power is turned on, drive motor 52 begins to rotate at its slowest speed (approximately 6 rpms) to facilitate engagement of the square drive shaft 50 with drive shaft receptacle 102. Shutters 54 and 56 are then manually raised using control ears 62 and 64, thereby opening interior cavity 38 of canister 30 to injection manifold 34.

The operator then selects the process at the information and control panel 28, here C-41, from a RUN mode menu, and enters the selection, which automatically causes system 10 to move into the Presoak mode. The warm water presoak is the typical first step in any standard process cycle in rotary processors, and functions not only to wash the various conduits and the canister, but also serves to warm system components, the film reels and the film. Presoak can be omitted from the process cycle, but is recommended for best results.

Activation of step 1 causes turret valve 118 to rotate to the position over the water cell air hose, which is one of the holes identified as 152*a–g*, and at the same time, the air compressor 35 is actuated. Air from the compressor, at approximately 4 psi, is directed through air supply line 150 and the appropriate air hole 152*a–g* where it is directed through air hose 156 to water cell 14. This forces water out of cell 14, causing it to flow via appropriate hoses up into wash water supply tube 182, through wash water supply apertures 184, and then through both fluid injection ports 176*a–f* and water injection ports 178*a–c*.

This injection under pressure by all nine of the injection ports causes the inside of canister 30 and the reels and film to be quickly and completely washed in a bath of tempered (temperature-controlled) water. Because fluid injection ports 176*a–f* are disposed in position facing the wedge shaped openings 58 and 60 in canister mounting plate 46, which open more than half of the canister end, the injected wash water will not only fully and quickly bathe the contents of the canister, but will also inject all of the way to the remote end of the canister, which is desirable in order to achieve a complete wash. The water which is being injected through water injection ports 178*a–c* first washes the front area of injection manifold 34 because those ports are slightly set back from the canister mounting plate 46 (see FIG. 6), and because of the recessed portion 200 (see FIG. 4). This wash water then also flows down into canister 30 and aids in the washing of the contents of the canister.

During injection of fluid into the canister, and during each processing step, drive motor 52 rotates at the speed selected by the user, normally about 30 rpms.

Pressure sensor port 172 and its remotely positioned pressure sensor sends a signal to computer 29 so that once the fluid level is in accordance with the preset level, pumping is terminated. In the event the pressure sensor is slow to operate or malfunctions, any excess water will pass out overflow duct 190. Once the desired level is reached within canister 30, air compressor 35 is turned off, and turret valve 118 moves away from its position over the selected air hole, to quickly vent the selected storage cell.

Immediately prior to the end of this Presoak step, normally approximately 20 seconds (commonly called the dump time), the computer causes activation of dump valve 104, which causes the solenoid to open, permitting wash water to flow through drain aperture 114, drain conduit 116, turret arm 120, and to the appropriate drain port 134*a–g*. Suitable hosing is connected to the drain ports to direct the wash water to a waste receptacle.

When the dump period is completed, the computer causes dump valve 104 to close, and the system is shifted to the Developer step, thereby causing turret valve 118 to shift to the appropriate position and directing air compressor 35 to start. This pumps air into the appropriate air hose 156 which is connected with developer chemistry, located in one of the cells 16–24. Developer is then directed up through one of the chemical supply lines 180*a–f*, through the interconnected fluid injection ports 176*a–f* and into canister 30. Again, because fluid is being injected under pressure, it will pass all of the way to the distal end of the canister, and completely and uniformly treat the film.

Again, turret valve 118 is caused to shift position once the appropriate level has been reached in canister 30, thereby venting the developer cell, and computer 29 causes the compressor to be deactivated.

Time-temperature compensation is used by the system, typically for the Developer step, although it can actually be used for any other step as well. During such a step, the computer takes periodic temperature measurements through temperature sensor port 170 and its probe 171. Near the end of this Developer step, the average canister temperature is compared to the target temperature, and if the temperature is too low, additional processing time is automatically added to this step. Conversely, if the temperature is too high, time is subtracted from this step. The amount of compensation depends on the magnitude of the temperature error and the specified compensation factor set by the user.

Once the dump time is reached, dump valve 104 is activated, causing developer to flow through conduits 114 and 116, turret arm 120 and into the appropriate drain port 134*a–g*. Because separate drain ports are utilized for each chemistry, the chemistries are kept separate, for either reuse or disposal. In the event the drain tank for developer is full, overflow troughs 140 and 142 will receive the excess developer, and cause it to be drained away through overflow ports 136*a–e*.

The next step, the Bleach step, is identical to the Developer step, except that turret valve 118 will take a different position, thereby causing the chemistry cell holding bleach to be pressurized, causing bleach to be injected into the canister. The Bleach step is performed for the time noted above, and once this cycle is completed, the bleach is dumped, and the First Wash cycle is initiated. This cycle is identical to Presoak step 1, so that all nine of the fluid injection ports 176*a–f* and water injection ports 178*a–c* are utilized to wash the system components, the reels and the film. After the wash water is dumped, the Fixer step is initiated, and fixer is injected into the canister. After that step is completed, the Second Wash step is performed.

Upon completion of the process, dump valve 104 is retained in its open position, turret valve 118 is moved to a default position, and an audible "end of process" alarm is actuated to signal to the operator that the process is complete. Drive motor 52 continues to operate, although at a slower speed such as 6 rpm, until the operator shuts the system down at the information and control panel 28. Canister 30 is removed from its mounting by first closing shutters 54 and 56 by utilization of control ears 62 and 64. Latch lever 70 is then shifted to the position depicted in FIG. 5*a*, thereby releasing the canister, permitting removal. The wet film can then be removed, treated in a stabilizer solution and then dried.

As shown best in FIG. 1, there is a space below the canister mounting area in box 12 to accommodate placement of the film for drying. A blower system (not shown) might be included here to accelerate this process.

These and other changes and modifications of the present invention can be made without departing from the spirit and scope of the present invention. Such changes and modifications are intended to be covered by the following claims.

I claim:

1. An apparatus for developing sensitized photographic material in selected chemical processing solutions taken from solution storage tanks, comprising:

a light-tight canister having a mounting surface and defining a cavity for holding the material to be developed, the mounting surface including at least one opening to admit chemicals therein;

the canister further including a light-tight shutter assembly in the mounting surface, which may be opened when the canister abuts an injection surface, thereby exposing the canister cavity to injection nozzles;

a central shaft extending substantially along an axial length of the canister;

a manifold injection structure, including a plurality of injection nozzles through which chemical processing solutions are injected into the canister cavity, having an injection surface against which the canister mounting surface is selectively mounted in a light- and fluid-tight fit;

a valving structure for controlling delivery under pressure of selected chemical processing solutions to the manifold injection structure; and a drain assembly located adjacent the manifold injection structure for draining spent chemicals out of the canister.

2. The apparatus of claim 1, wherein the shutter assembly comprises at least one valve which is slidable in a plane which is perpendicular to the axial length of the canister.

3. The apparatus of claim 2, wherein the shutter assembly is slidable to open at least a portion of the upper half of on end surface of the canister which faces the injection surface.

4. The apparatus of claim 3, wherein the canister is cylindrical and the valve is rotatably slidable to open a lower semicircular portion of the end of the canister and at least a portion of an upper semicircular portion.

5. The apparatus of claim 1, further including a light-tight air vent, wherein the shutter assembly when opened, defines an arc extending above horizontal so that air trapped within the cavity can under certain conditions pass through the arc, into the manifold injection structure and out through the air vent to the atmosphere.

6. The apparatus of claim 5, wherein the shutter assembly includes a double leaf shutter having a total opened arc of greater than one hundred and eighty degrees.

7. The apparatus of claim 1, further comprising a lever located adjacent the injection structure and at least a pair of spaced pins projecting from the canister adjacent its mounting surface, the lever controlling the operation of a pin engagement mechanism to engage the pins to selectively lock the canister mounting surface and the injection surface together in an abutting relationship.

8. The apparatus of claim 1, further including a shaft outlet located adjacent the manifold injection surface, wherein the shaft outlet is connected to a drive motor which causes the shaft outlet and the central shaft to rotate to produce agitation within the canister cavity.

9. The apparatus of claim 1, further including a pressure sensor mounted in pressure communication with the canister cavity to measure the solution level within the cavity during processing, and a controller, with the pressure sensor being operably connected to the controller to control the solution level.

10. The apparatus of claim 1, further including a temperature sensor in temperature communication with the canister cavity for sensing the temperature of the solutions during processing, and a controller, the temperature sensor being operably connected to the controller so that a timed chemical exposure cycle of the material to be processed may be adjusted.

11. The apparatus of claim 1, wherein the drain assembly has an overflow drain opening defined on the injection surface above the level of at least some of the injection nozzles, for preventing the cavity from filling with solution beyond a predetermined level, and to selectively permit constant injection and overflow of solution.

12. The apparatus of claim 1, wherein the drain assembly further includes an automatically activated dump valve to regulate the solution flow out of the canister cavity, a plurality of solution recovery tanks, and a drain control system including a drain control valve which can take a plurality of positions to drain spent solution into any one of the plurality of solution recovery tanks.

13. The apparatus of claim 1, wherein the drain assembly further includes an automatically activated dump valve to regulate the solution flow out of the canister cavity, and wherein the valving structure further includes a drain control valve which can take a plurality of positions to drain spent solution into any one of a plurality of waste receptacles.

14. An apparatus for developing sensitized photographic material in selected chemical processing solutions taken from solution storage tanks, comprising:

a light-tight canister having a mounting surface and defining a cavity for holding the material to be developed, the mounting surface including at least one opening to admit chemicals therein;

a manifold injection structure, including a plurality of injection nozzles through which chemical processing solutions are injected into the canister cavity, having an injection surface against which the canister mounting surface is selectively mounted in a light- and fluid-tight fit;

a valving structure for controlling delivery under pressure of selected chemical processing solutions to the manifold injection structure; and a drain assembly for draining spent chemicals out of the canister, the drain assembly having an overflow drain opening defined in the injection surface above the level of at least some of the injection nozzles.

15. The apparatus of claim 13 or 14, wherein the valving structure includes a single, automatically adjustable valve member which controls both the delivery of the selected chemical processing solution and the dumping of spent solution into any one of a plurality of waste receptacles.

16. The apparatus of claim 15 wherein the single valve member is in the form of a radially extending arm, rotatable about an arc to direct the delivery and dumping of solutions.

17. The apparatus of claim 16, wherein the radially extending arm pivots about a fixed end including a conduit for carrying spent solutions interconnected with the dump valve, and a conduit member for conveying the spent solution, and further comprising a plurality of waste receptacle conduits positioned to receive the spent solution, depending upon the position of the radially extending arm.

18. The apparatus of claim 17 further comprising a plurality of pressurized solution storage tanks, and wherein the radially extending arm carries a pressurized gas conduit, and the valving structure includes a plurality of gas conduits which lead to the processing solution storage tanks which further include discharge conduits from which solution can flow to the manifold injection structure, the gas conduits being positioned to receive pressurized gas, depending upon the position of the radially extending arm.

19. The apparatus of claim 16 further comprising a magnet sensing system comprising a magnet positioned on the radially extending arm, and a magnet sensor system stationarily mounted to the apparatus to sense the position of the magnet on the radially extending arm.

20. The apparatus of claim 16, wherein the drain assembly further includes an intelligent controller, and a sensor in the radially extending arm and a sensor activator located at both ends of the arc, to provide the controller with a first valve position and a second valve position for interpolation estimation of the position of the arm.

21. The apparatus of claim 1 or 14, the manifold injection structure further including at least one wash water supply conduit with a plurality of spaced holes for receiving and distributing wash water, and a plurality of solution distribution conduits for receiving and distributing processing solution and having correspondingly spaced holes and positioned in communication with at least some of the wash water conduit spaced holes for selectively distributing chemistry and receiving and distributing wash water into the canister, the solution distribution conduits including a portion of smaller diameter and a portion of larger diameter, the larger diameter portion being closer to the canister than the smaller diameter portion, the spaced holes of the solution distribution conduits being in the larger diameter portion.

22. The apparatus of claim 1 or 14, further comprising a computer control system for controlling the operation of the apparatus.

* * * * *